United States Patent [19]

Knapp

[11] Patent Number: 4,531,948

[45] Date of Patent: Jul. 30, 1985

[54] ALCOHOL AND GASOHOL FUELS HAVING CORROSION INHIBITING PROPERTIES

[75] Inventor: Gordon G. Knapp, Baton Rouge, La.

[73] Assignee: Ethyl Corporation, Richmond, Va.

[21] Appl. No.: 619,978

[22] Filed: Jun. 13, 1984

[51] Int. Cl.[3] ..... C10L 1/22

[52] U.S. Cl. ..... 44/53; 44/56; 44/63; 44/71; 252/392; 252/396

[58] Field of Search ..... 44/53, 56, 63, 71; 252/392, 396

[56] References Cited

U.S. PATENT DOCUMENTS

| | | | |
|---|---|---|---|
| 2,568,876 | 9/1951 | White et al. | 44/66 |
| 3,443,918 | 5/1969 | Kautsky et al. | 44/63 |
| 4,165,292 | 8/1979 | Davis et al. | 252/392 |
| 4,396,399 | 8/1983 | Kaufman et al. | 44/63 |
| 4,440,545 | 4/1984 | Weidig | 252/396 |

*Primary Examiner*—Y. Harris-Smith

*Attorney, Agent, or Firm*—Donald L. Johnson; John F. Sieberth; W. G. Montgomery

[57] ABSTRACT

Corrosion caused by gasohol or alcohol motor fuels is inhibited by the addition of a corrosion inhibiting amount of the combination of (A) at least one monoalkenylsuccinic acid wherein the alkenyl group contains about 8 to 30 carbon atoms and (B) a polyisobutenyl succinimide of an alkylenepolyamine.

7 Claims, No Drawings

ALCOHOL AND GASOHOL FUELS HAVING CORROSION INHIBITING PROPERTIES,

BACKGROUND

In the past, metal corrosion caused by conventional motor fuels such as gasoline was not much of a problem because such hydrocarbon fuels are inherently non-corrosive. However, with the advent of fuels containing alcohols such as gasohol or straight alcohol fuels, corrosion has become a major problem because such fuels are corrosive. It has been reported that this corrosion is due to the presence of acidic contaminants in such fuels such as formic acid. It is almost impossible to avoid such contaminants because they occur in fuel grade alcohols and are also formed in storage as normal alcohol oxidation products.

It is known from U.S. Pat. No. 4,305,730 that polymerized linoleic acid, especially trimer, is an effective corrosion inhibitor for alcohol-type motor fuels. It has now been discovered that the corrosion inhibiting properties of such polymerized polyunsaturated aliphatic monocarboxylic acids are improved by the use of the co-additives described herein.

SUMMARY

According to the present invention, metal corrosion caused by alcohol-type motor fuels is inhibited by adding to the fuel a combination of (A) at least one monoalkenylsuccinic acid wherein the alkenyl group has 8 to 30 carbon atoms and (B) a polyisobutenyl succinimide of an alkylenepolyamine.

DESCRIPTION OF PREFERRED EMBODIMENTS

The invention provides a liquid fuel adapted for use in an internal combustion engine said fuel comprising from 5 to 100 weight percent of one or more alcohols, from 0 to 95 weight percent gasoline and a corrosion inhibiting amount of the combination of (A) at least one monoalkenylsuccinic acid wherein the alkenyl group has 8 to 30 carbon atoms and (B) a polyisobutenyl succinimide of an alkylenepolyamine.

The additive combination of this invention can be beneficial in any engine fuel containing or consisting of an oxygenate. Such fuels include gasoline-alcohol mixtures referred to as "gasohol" as well as straight alcohol fuels. Useful alcohols are methanol, ethanol, n-propanol, isopropanol, isobutanol, t-butanol, 2-methyl-2-propanol, mixtures thereof such as methanol and t-butanol and the like. Gasohols usually contain about 2 to 30 volume percent alcohol. At concentrations above 10 volume percent phase separation problems are encountered especially in the presence of water.

Phase separation can be minimized by including co-solvents in the gasohol such as ethers, ketones, esters and the like. An especially useful co-solvent is methyl tert-butyl ether which also serves to increase octane value.

The additive combination may be used at a concentration which provides the required amount of corrosion protection. A useful range is about 1 to 5000 pounds per thousand barrels (ptb). A more preferred range is about 5 to 2000 ptd and the most preferred concentration is 5 to 500 ptb.

The monoalkenylsuccinic acids (Component A) are well known in the art. These acids are readily prepared by the condensation of an olefin with maleic anhydride followed by hydrolysis (see U.S. Pat. Nos. 2,133,734 and 2,741,597). Suitable monoalkenylsuccinic acids include octenylsuccinic acid, decenylsuccinic acid, undecenylsuccinic acid, dodecenylsuccinic acid, pentadecenylsuccinic acid, octadecenylsuccinic acid and isomers thereof having alkenyl groups of various hydrocarbon structures. The preferred monoalkenylsuccinic acid is dodecenylsuccinic acid, more preferably dodecenylsuccinic acid prepared from propylene tetramer.

While an alkenyl group ranging from 8 to 30 carbon atoms is preferred as indicated above, it is contemplated that substantially any alkenylsuccinic acid or its equivalent anhydride may be employed in the fuels of the present invention provided it is sufficiently soluble in the fuel to be effective in combination with the alkenyl succinimide compounds of the invention as a corrosion inhibitor. Further, since relatively pure olefins are difficult to obtain and are often too expensive for commerical use, alkenylsuccinic acids prepared as mixtures by reacting mixed olefins with maleic anhydride may be employed in this invention as well as relatively pure alkenyl succinic acids. Mixed alkenylsuccinic acids wherein the alkenyl group averages 6–8, 8–10 and 10–12 carbon atoms are commercially available.

Component B of the combination is an alkenyl succinimide of an amine having at least one primary amine group capable of forming an imide group. Representative examples are given in U.S. Pat. Nos. 3,172,892; 3,202,678; 3,219,666; 3,272,746; 3,254,025 and 3,216,936. The alkenyl succinimides may be formed by conventional methods such as by heating an alkenyl succinic anhydride, acid, acid-ester or lower alkyl ester with an amine containing at least one primary amine group. The alkenyl succinic anhydride may be made readily by heating a mixture of olefin and maleic anhydride to about 180°–220° C. The olefin is preferably a polymer or copolymer of a lower mono-olefin such as ethylene, propylene, isobutylene and the like. The more preferred source of alkenyl group is from polyisobutylene having a molecular weight up to 10,000 or higher. In a still more preferred embodiment, the alkenyl is a polyisobutylene group having a molecular weight of about 700–5,000 and most preferably about 900–2,000.

Amines which may be employed include any that have at least one primary amine group which can react to form an imide group. A few representative examples are:

methylamine
2-ethylhexylamine
n-dodecylamine
stearylamine
N,N-dimethyl-propanediamine
N-(3-aminopropyl)morpholine
N-dodecyl propanediamine
N-aminopropyl piperazine ethanolamine
N-ethanol ethylene diamine and the like.

The preferred amines are the alkylenepolyamines such as propylene diamine, dipropylene triamine, di-(1,2-butylene)-triamine, and tetra-(1,2-propylene)pentaamine.

The most preferred amines are the ethylene polyamines which have the structure $H_2N—CH_2CH_2N-H—_nH$ wherein n is an integer from one to about ten. These include:

ethylene diamine
diethylene triamine triethylene tetraamine
tetraethylene pentaamine
pentaethylene hexaamine and the like including mixtures thereof in which case n is the average value of the mixture. These ethylene polyamines have a primary amine group at each end and so can form mono-alkenylsuccinimides and bis-alkenylsuccinimides. The most preferred for use in this invention are the bis-alkenylsuccinimides.

The weight ratio of component A to component B in the combination can vary over a wide range such as 1 to 10 parts A to 1 to 10 parts B. In a more preferred embodiment, the weight ratio is about 0.5–5 parts component A for each part component B. In a still more preferred embodiment there are 0.6–4.0 parts component A per each part component B. The most preferred ratio is 1:1.

Components A and B can be separately added to the fuel. More preferably, components A and B are premixed to form a package and this package is added to the fuel in an amount sufficient to provide the required degree of corrosion protection.

Most preferably, components A and B are also premixed with a solvent to make handling and blending easier. Suitable solvents include alcohols (e.g., methanol, ethanol, isopropanol), ketones (acetone, methyl ethyl ketone), esters (tert-butyl acetate) and ethers (e.g., methyl tert-butyl ether).

Aromatic hydrocarbons are very useful solvents. These include benzene, toluene, xylene and the like. Excellent results can be obtained using xylene.

The concentration of the active components A and B in the package can vary widely. For example, the active content can range from about 5 weight percent up to the solubility limit of A or B in the solvent. With xylene, a total active content of about 5–60 weight percent is generally used, especially about 50 weight percent.

Tests were conducted to measure the anti-corrosion properties of the additive combination. In the tests, the corrosion of steel cylinder rods (½ in.×3 in.) semisubmersed in test fluid was measured under different test conditions. The rods were first cleaned with carborundum 180 , polished with crocus cloth, washed with acetone and then dried at room temperature.

Each rod was weighed and then semisubmersed in 10 milliters of the test fluid in a sealed bottle for the specified time at the specified temperature.

At the end of the test period, the rods were removed from the fuel, and after loose deposits were removed with a light brush, the rods were washed and dried as at the start of the test and then reweighed. Any change in rod weight was recorded. Loss of weight indicated corrosion.

A series of three tests were carried out lasting 7 days, 14 days and 30 days, respectively. The series of tests were conducted in fuels comprising 5 volume percent methanol and 5 volume percent t-butanol in gasoline (indolene) containing 0.5 weight percent of 5.0 percent acetic acid in water. The tests were conducted at 25° C.

The test additives added to the test fuels were equal weight mixtures (100 ptb) of either dodecenylsuccinic acid prepared from dodecene or from propylene tetramer, in combination with polyisobutenylsuccinimide[1] and 50 ptb of each individual component.

The results of these tests which are set out in the table below demonstrate the excellent anticorrosion properties of a fuel containing an additive combination of the invention.

TABLE

| Additives | Weight reduction (mg.) |
|---|---|
| **7-DAY TESTS** | |
| none | 7.5 |
| polyisobutenylsuccinimide | 6.9 |
| dodecenylsuccinic acid from dodecene | 5.7 |
| dodecenylsuccinic acid from propylene tetramer | 3.8 |
| polyisobutenylsuccinimide + dodecenylsuccinic acid from dodecene | 0.8 |
| polyisobutenylsuccinimide + dodecenylsuccinic acid from propylene tetramer | 0.3 |
| **14-DAY TESTS** | |
| none | 10.3 |
| polyisobutenylsuccinimide | 8.7 |
| dodecenylsuccinic acid from dodecene | 10.5 |
| dodecenylsuccinic acid from propylene tetramer | 8.9 |
| polyisobutenylsuccinimide + dodecenylsuccinic acid from dodecene | 1.4 |
| polyisobutenylsuccinimide + dodecenylsuccinic acid from propylene tetramer | 0.9 |
| **30 DAY TESTS** | |
| none | 12.1 |
| polyisobutenylsuccinimide | 9.1 |
| dodecenylsuccinic acid from dodecene | 15.1 |
| dodecenylsuccinic acid from propylene tetramer | 15.1 |
| polyisobutenylsuccinimide + dodecenylsuccinic acid from dodecene | 2.8 |
| polyisobutenylsuccinimide + dodecenylsuccinic acid from propylene tetramer | 0.8 |

[1]Bis-polyisobutenylsuccinimide of an ethylenepolyamine mixture having average composition of tetraethylenepentamine and having a nitrogen content of about 2.6%.

I claim:

1. A liquid fuel adapted for use in an internal combustion engine, said fuel consisting essentially of 5 to 100 weight percent of one or more alcohols, 0 to 95 weight percent gasoline and a corrosion inhibiting amount of a combination of (A) at least one monoalkenylsuccinic acid wherein the alkenyl group contains about 8 to 30 carbon atoms and (B) a polyisobutenyl succinimide of an alkylenepolyamine.

2. A liquid fuel of claim 1 wherein said monoalkenylsuccinic acid is dodecenylsuccinic acid.

3. A liquid fuel of claim 1 wherein said polyisobutenyl succinimide is a polyisobutenyl succinimide of an ethylene polyamine having the formula.

$N_2H—CH_2CH_2NH—$hd nH wherein n is an integer from 1 to 10 or mixtures thereof and said polyisobutenyl has a molecular weight of 700–5000.

4. A corrosion inhibiting concentrate consisting essentially of a solvent containing 5 to 60 weight percent of a combination of (A) at least one monoalkenylsuccinic acid in which the alkenyl group has about 8 to 30 carbon atoms and (B) a polyisobutenyl succinimide of an alkylenepolyamine.

5. A corrosion inhibiting concentrate of claim 4 wherein monoalkenylsuccinic acid is dodecenylsuccinic acid.

6. The corrosion inhibiting concentrate of claim 5 wherein said polyisobutenyl succinimide is a polyisobutenyl succinimide of an ethylene polyamine having the formula $N_2H—CH_2CH_2NH—$hd nH wherein n is an integer from 1 to 10 or mixtures thereof and said polyisobutenyl has a molecular weight of 700–5000.

7. A liquid fuel adapted for use in an internal combustion engine, said fuel consisting essentially of a major amount of a hydrocarbon distillate in the gasoline distillation range and from about one to about 30 volume percent of one or more alkanols containing from 2 to about 4 carbon atoms and a corrosion inhibiting amount of a combination of (A) at least one monoalkenylsuccinic acid in which the alkenyl group has about 8 to 30 carbon atoms and (B) a polyisobutenyl succinimide of an alkylenepolyamine.

* * * * *

UNITED STATES PATENT AND TRADEMARK OFFICE

CERTIFICATE OF CORRECTION

PATENT NO. : 4,531,948

DATED : JULY 30, 1985

INVENTOR(S) : GORDON G. KNAPP

It is certified that error appears in the above-identified patent and that said Letters Patent is hereby corrected as shown below:

Column 2, lines 64-65, reads "$H_2N—CH_2CH_2NH—_nH$" and should read -- $H_2N—(CH_2CH_2NH)—_nH$ --;

Column 4, line 47, reads "$N_2H—CH_2CH_2NH—$hd nH" and should read -- $H_2N—(CH_2CH_2NH)—_nH$ --;

Column 4, line 66, reads "$N_2H—CH_2CH_2NH—$hd nH" and should read -- $H_2N—(CH_2CH_2NH)—_nH$ --.

Signed and Sealed this

Fourteenth Day of April, 1987

*Attest:*

*Attesting Officer*

DONALD J. QUIGG

*Commissioner of Patents and Trademarks*